United States Patent [19]

Gorgone

[11] Patent Number: 4,977,583

[45] Date of Patent: Dec. 11, 1990

[54] CASSETTE CASH BOX FOR CURRENCY VALIDATOR

[75] Inventor: Robert L. Gorgone, Mentor, Ohio

[73] Assignee: Ardac, Inc., Eastlake, Ohio

[21] Appl. No.: 332,024

[22] Filed: Apr. 3, 1989

[51] Int. Cl.[5] ..... B07C 5/342; B65B 35/50

[52] U.S. Cl. ..... 377/8; 235/100; 209/534; 194/207

[58] Field of Search ..... 377/8; 194/206, 207; 209/534; 235/100

[56] References Cited

U.S. PATENT DOCUMENTS

| | | | |
|---|---|---|---|
| 3,447,655 | 6/1969 | Tanaka et al. | 194/206 |
| 4,337,864 | 7/1982 | McLean | 377/8 |
| 4,653,647 | 3/1987 | Hashimoto | 377/8 |
| 4,817,804 | 4/1989 | Kawano et al . | 209/534 |
| 4,830,742 | 5/1989 | Takesako | 209/534 |
| 4,854,247 | 8/1989 | Sciortino et al. | 194/206 |

*Primary Examiner*—John S. Heyman

*Attorney, Agent, or Firm*—Renner, Kenner, Greive, Bobak, Taylor & Weber

[57] ABSTRACT

A cassette cash box for currency validators is presented. The cash box is received by the housing of a currency validator and retained thereby by only a mechanical locking interconnection. Received within the cash box is a counter which is optically coupled with a microprocessor in the currency validator housing. Each time a piece of currency is placed in the cash box, the optical coupler receives a signal which increments the counter. At any point in time, the count in the counter corresponds to the amount of currency maintained by the cash box. At regular service intervals, the cash box is removed and replaced with an empty one. The removed cash box is returned to an authorized service area where the count in the counter is compared with the amount of currency in the cash box. The counter is accessed and read by an application thereto of a special numeric code, known only to authorized personnel. In like manner, the counter is reset by the application of another specific secret code.

15 Claims, 1 Drawing Sheet

CASSETTE CASH BOX FOR CURRENCY VALIDATOR

TECHNICAL FIELD

The invention herein resides in the art of currency validators and, more particularly, to a cash box for such validators. More specifically, the invention presents a cassette cash box which retains an account of the number of pieces of currency received thereby and which may be readily removed and replaced with respect to the validator.

BACKGROUND ART

Heretofore various types of currency validators have been known in the art. Such apparatus is typically used for receiving and authenticating a paper tendered as valid currency, and exchanging goods, services, and/or change in return therefore. Known currency validators are typically either of the slot or tray acceptor type. In the former, a piece of currency is entered into a slot and is transported along a note path where various authentication test are performed. When the currency is validated, it is punched or otherwise deposited into a cash box where it is retained. In similar fashion, in tray acceptors a piece of currency is laid on a tray and slid into a housing where it is temporarily locked while validation tests are performed. Once validated, the currency is again deposited in a cash box. In both cases, the cash box progressively grows with respect to the amount of currency retained therein. Accordingly, service personnel must remove the currency on a periodic basis.

It is well known that the accessibility to cash often gives rise to temptations of wrongfully taking or retaining the same. When the amount of currency returned by a service person does not equal the total value of coins, services, and goods dispensed, it is difficult to pinpoint whether the error is the result of the validator itself or dishonesty on behalf of the individual. Further, monitoring of the same is time consuming and expensive.

It is believed to be most beneficial if the cash box of a currency validator may be treated as a cassette, totally removable from the machine for replacement by an empty cash box cassette. It is further believed to be beneficial if the cash box itself can evidence a count of the amount of currency received thereby and for which an account must be given by the service personnel. While some cassette cash boxes have been known for currency validators, they have typically been complicated mechanical structures secured by various types of locks and mechanical linkages requiring special tools or keys for accessibility. Such tools and keys would typically be available only to specific authorized personnel. However, the "picking" or other defeat of such mechanical systems has generally been within the capabilities of the associated service personnel. Heretofore, there have been no sophisticated electronically coded cassette cash boxes for defeating the wrongful attempts of the mechanically astute to invade the same.

DISCLOSURE OF INVENTION

In light of the foregoing, it is a first aspect of the invention to provide a cassette cash box for currency validators in which the cash box may be quickly and easily removed and replaced in the validator.

Another aspect of the invention is the provision of a cassette cash box for a currency validator in which the cash box includes means for recording the amount of currency received thereby, and which means cannot be accessed and/or altered by service personnel.

Still a further aspect of the invention is the provision of a cassette cash box for currency validators in which the only interconnection between the cash box and the validator itself constitutes a locking mechanism which may be activated and deactivated by service personnel.

Yet another aspect of the invention is the provision of a cassette cash box for currency validators in which tallying means are included in the cash box which can only be read and/or reset by specific authorized personnel using special equipment.

An additional aspect of the invention is the provision of a cassette cash box for currency validators which is easily adapted for implementation with presently existing currency validators, which is cost effective, and which is durable and reliable in use.

The foregoing and other aspects of the invention which will become apparent as the detailed description proceeds are achieved by the improvement in a currency validator of a cash box, comprising: a receptacle having an opening for receiving paper currency therethrough; and recordation means maintained by said receptacle for tallying a number of pieces of paper currency received by said receptacle.

Other aspects of the invention are attained by a currency validator, comprising: first means for testing a piece of currency for authenticity; a cash box; second means in communication with said first means for depositing said piece of currency into said cash box after said piece of currency has been validated; and third means carried by said cash box for tallying the number of pieces of currency deposited in said cash box.

DESCRIPTION OF DRAWINGS

For a complete understanding of the objects, techniques and structure of the invention reference should be had to the following detailed description and accompanying drawings wherein.

BEST MODE FOR CARRYING OUT THE INVENTION

Figure 1:
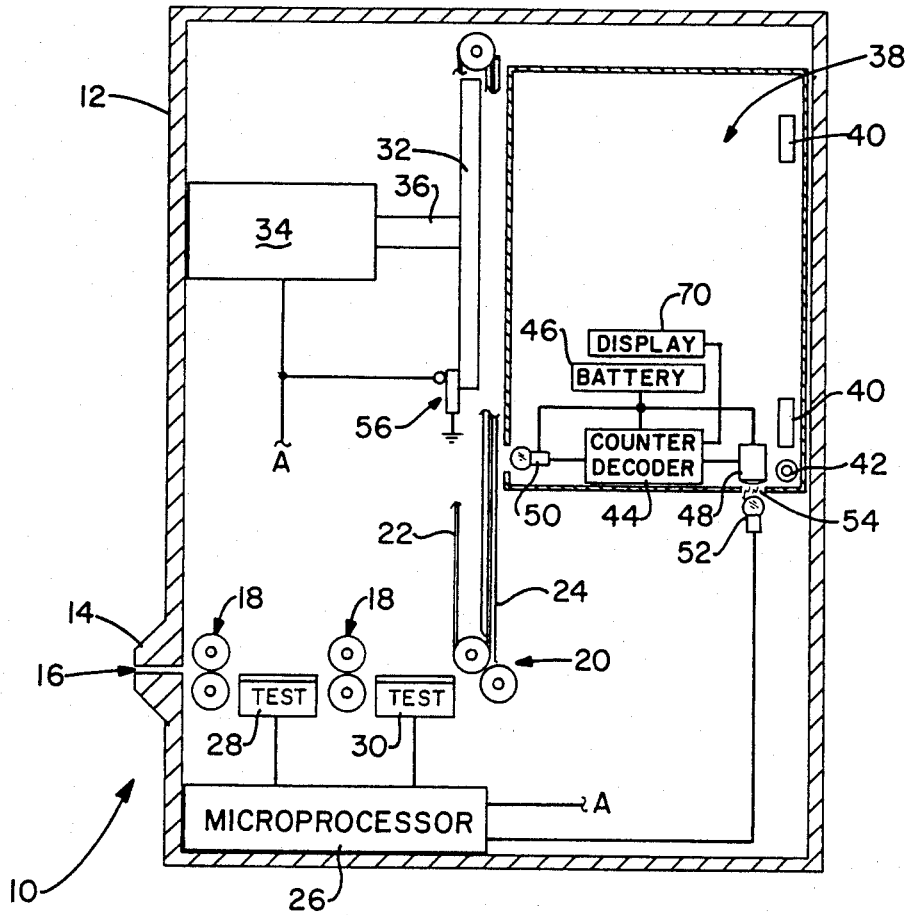
FIG. 1 is a sectional illustrative side view of a slot acceptor type of currency validator incorporating the concept of the invention.

Referring now to the drawings and more particularly FIG. 1, it can be seen that a currency validator is designated generally by the numeral 10. While the currency validator 10 is of the slot acceptor type, it will be understood that the concept of the invention is equally applicable to tray acceptors as well. The currency validator 10 includes a housing 12 having an escutcheon 14 extending from a front panel thereof. The escutcheon 14 defines a slot 16 into which a piece of paper tendered as valid currency may be entered. This slot 16 constitutes the beginning of a note path in which the paper will travel during the authentication process.

At the exit of the slot 16 pairs of transport rollers 18 are positioned, forming a bite therebetween. The rollers 18, caused to rotate by a motor with appropriate gearing, engage the currency and transport it along a horizontal portion of the note path. The note then enters the bite between the rollers 20 presented at an area of transition for the note path where it passes from horizontal to vertical. At this point, a belt 22, caused to rotate in standard fashion about a vertical path, engages the currency and transports it along a pair of bill rails 24. It will be appreciated by those skilled in the art that the transport structure just described is presented in pairs, with corresponding sets of rollers 18,20, drive belts 22, and bill rails 24 being presented into the paper of FIG. 1 in spaced relation from the elements actually shown. The spacing of such elements is typically slightly less than the width of the currency being handled. In other words, the currency is engaged and transported by the described apparatus by engagement of opposed longitudinal edges thereof.

Also maintained within the housing 12 is a microprocessor or other control unit 26. The microprocessor 26 communicates with testing circuitry 28,30 maintained along the note path which performs various tests on the currency as it is being transported. As is well known to those skilled in the art, the testing circuitry 28,30 would typically include light sources, photodetectors, reticles, magnetic reading heads, and the like. The outputs of the test circuits 28,30 are passed to the microprocessor 26 where they are analyzed and a determination is made as to the authenticity of the paper tendered. While this analysis is being made, the currency is maintained in an escrow position in the note path in juxtaposition to a punch 32.

As shown in FIG. 1, the punch 32 is interconnected with a solenoid or motor 34 by means of a rod or stem 36. Upon a determination by the microprocessor 26 that the paper is, indeed, a valid piece of currency, the microprocessor 26 actuates the solenoid or motor 34 to cause the punch 32 to push the currency from the note path into the cash box 38. This cash box, typically comprising five closed sides with the front side thereof being open to the extent that a window is provided for receiving the punch 32 in reciprocating action, is secured to the housing 12 by means of locking bolts or pins 40. The lock bolts 40 are preferably actuated by a key maintained by service personnel who will access the validator 10 to remove the cash box 38 and replace it with an empty one in a manner to be discussed hereinafter. It will be appreciated that a pair of pins 42 extend from opposite bottom corners of the cash box 38, the same assisting in positioning, alignment, and retention of the cash box 28 within the housing 12. Further, the pins 42 allow the cash box 38 to be pivoted from the housing 12, if such action is desired.

Maintained within the cash box 38 is an integrated circuit chip 44 which, in a preferred embodiment of the invention, constitutes an up counter and decoder. A battery 46 is also contained within the cash box 38 to supply power to the counter/decoder 44, a photodetector 48, and a light source 50. It should be appreciated that the only interconnection between the cash box 38 and the housing 12 of the validator 10 is the mechanical interconnection achieved by the lock bolts 40 and pins 42. No other mechanical or electrical interconnection between the cash box 38 and the remainder of the validator 10 is present.

Retained by the housing 12 and positioned opposite the photodetector 48 is a light source 52, such as a light emitting diode (LED), which is activated by the microprocessor 26. Light emitted from the LED 52 is communicated to the photodetector 48 through an opening or window 54 in the housing of the cash box 38. The structure 48,52,54 constitutes an optical coupler from the microprocessor 26 retained within the housing 12 of the validator 10 and the counter/decoder 44 retained within the cash box 38.

In operation, the LED 52 is illuminated for a short duration of time under control of the microprocessor 26 each time the microprocessor 26 causes the solenoid or motor 34 to actuate, forcing the punch 32 to reciprocate into the cash box 38, depositing a piece of currency therein. The light pulse emitted from the LED 52 is sensed by the photodetector 48 which produces an output signal which is applied to the counter 44 which increments the same. Assuming that the cash box 38 is empty and the counter 44 is reset to "0" at the beginning, as the currency validator 10 makes transactions and the microprocessor 26 causes the punch 32 to deposit currency into the cash box 38, the count maintained in the counter 44 at any point in time will equal the number of pieces of currency retained in the cash box 38.

It will be readily appreciated by those skilled in the art that the microprocessor may also be used to monitor movement of the rod 36 or punch 32. By actually monitoring the movement of the punch 32, rather than relying upon the actuation signal sent by the microprocessor 26 to the solenoid or motor 34, the count maintained by the counter 44 is even more indicative of the number of pieces of currency retained by the box 38. In such an embodiment, a switch 56 may be positioned such that it is actuated by the punch 32 during its reciprocating movement, such actuation passing a signal back to the microprocessor 26, indicating that the punch 32 had, indeed, been reciprocated. The microprocessor 26 may then emit a short duration signal to the LED 52 for the requisite illumination to be sensed by the photodetector 48 which, in turn, applies an incrementing signal to the counter 44.

It should be appreciated that the counter/decoder 44 comprises a "smart" integrated circuit chip that may be maintained in a single dual-in-line (DIL) package. In a preferred embodiment, the chip 44 is capable of receiving a digital input signal code from the photodetector 48 and, based upon that code, perform one of the functions of (1) incrementing the counter of the chip 44, (2) resetting such counter, or (3) reading out the contents of the counter. In the preferred embodiment, with the cash box 38 received by the housing 12, a single light pulse from the LED 52 is converted to a single electrical pulse by the photodetector 48 to increment the counter 44, indicating the depositing of a piece of currency within the cash box. It is most preferred that the counter of the chip 44 be an up-counter, capable of being incremented, but not decremented.

Figure 2:
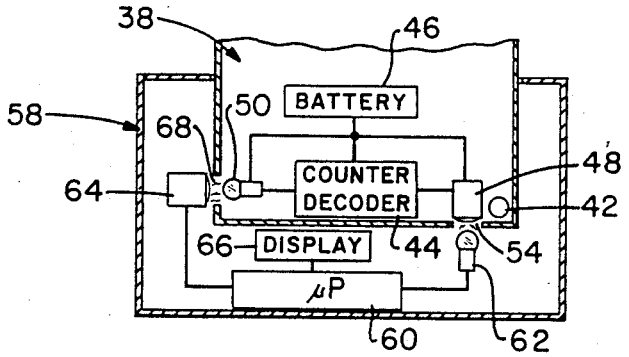
FIG. 2 is a schematic block diagram of the cash box of the invention received within a jig for reading and resetting a counter received within the cash box.

According to the invention, the cash box 38 may be removed from the housing 12 by field service personnel for delivery to authorized personnel having access to the apparatus necessary for "reading" the counter 44 to compare the count thereof with the contents of the cash box 38. Such apparatus, which may also be used to reset the counter 44, is shown in FIG. 2. As illustrated, a jig or fixture 58 has a microprocessor or "smart" chip 60, LED 62, photodetector 64, and display unit 66 maintained therein. The fixture 58 has an opening therein for receiving the cash box 38, such that the LED 62 is aligned with the photodetector 48 through the opening 54, while the light source or LED 50 aligns with the photodetector 64 through an opening 68 provided in the cash box 38.

With the fixture 58 and cash box 38 engaged as presented above, the microprocessor 60 may be activated to produce a first serially coded output signal to the LED 62 where the signal is converted from digital electric to digital optical. That signal is received and reconverted by the photodetector 48, which applies it to the chip 44, the decoder of which recognizes it as a "READ" signal. The counter of the chip 44 then serially reads out its contents to the LED 50 which converts those digital electric signals to digital optical signals, the same being received and reconverted to digital electric signals by the photodetector 64 for application to the microprocessor 60. The count may there be appropriately converted for application to an appropriate display 66 such as a liquid crystal display (LCD), from which manual recordation may be made and compared against the actual contents of the cash box 38.

A second coded signal may be applied from the microprocessor 60 to the counter 44 for then resetting the counter. Once the cash box 38 is emptied and the counter 44 is reset, the cash box may be subsequently placed in the housing 12 of a suitable currency validator 10.

It is also contemplated as a portion of this invention that the cash box 38 may include a display 70, such as an LCD, connected to the counter 44 and visible through an appropriate window or opening in the cash box housing. In such an embodiment, the fixture 58 could be simplified such that the microprocessor chip 60 would serve only to reset the counter 44, obviating the need for a display 66. Further, such a structure clearly indicates to the field service personnel that a currency count has been maintained, discouraging any attempts to defeat the system.

It should now be appreciated that no electrical or electromechanical interconnections are necessary between the cash box 38 or the housing 12 or jig 58. The requisite power source for the cash box 38 is contained therein in the form of a battery 46. Accordingly, the engagement and disengagement of the cash box with either may be reliably and easily achieved. Further, with the counter 44 being an up-counter, and accessible only through an optical digital code, unauthorized access or tampering is effectively precluded.

Thus it can be seen that the objects of the invention have been satisfied by the structure presented hereinabove. While in accordance with the patent statutes only the best mode and preferred embodiment of the invention has been presented and described in detail, it will be understood that the invention is not limited thereto or thereby. Accordingly, for an appreciation of the true scope and breadth of the invention, reference should be had to the following claims.

What is claimed is:

1. The improvement in a currency validator of a cash box, comprising:

a receptacle having an opening for receiving paper currency therethrough;

recordation means maintained by said receptacle for tallying a number of pieces of paper currency received by said receptacle;

locking means for selectively securing said receptacle to the currency validator and selectively disengaging said receptacle therefrom for removal of said receptacle from the currency validator;

a first photodetector received by said receptacle, said first photodetector receiving an optical signal from a first light source maintained by the currency validator, converting said optical signal to an electrical signal, and applying said electrical signal to said counter;

a second light source maintained within said receptacle and interconnected with said counter; and a fixture adapted to receive said receptacle when said receptacle is removed from the currency validator, said fixture having a third light source positioned for communication with said first photodetector, and a second photodetector positioned for communication with said second light source.

2. The improvement in a currency validator as recited in claim 1, wherein said recordation means comprises a counter.

3. The improvement in a currency validator as recited in claim 2, wherein said counter comprises an up counter, which can only be incremented and not decremented.

4. The improvement in a currency validator as recited in claim 3, wherein said counter requires the application thereto of a code to be read.

5. The improvement in a currency validator as recited in claim 4, wherein said counter requires the application thereto of a code to be reset.

6. The improvement in a currency validator as recited in claim 2, wherein said counter is incremented by the application thereto of an optically coupled signal.

7. The improvement in a currency validator as recited in claim 2, further comprising a battery received by said receptacle, said battery being interconnected with said counter.

8. The improvement in a currency validator as recited in claim 1, further comprising control means maintained within said fixture and interconnected between said third light source and said second photodetector for applying a first code to said counter through said third light source and first photodetector to read said counter through said second light source and second photodetector, and for applying a second code to said counter through said third light source and first photodetector to reset said counter.

9. The improvement in a currency validator as recited in claim 8, further comprising a display maintained by said fixture and interconnected with said counter.

10. A currency validator, comprising:

first means for testing apiece of currency for authenticity;

a cash box;

second means in communication with said first means for depositing said piece of currency into said cash box after said piece of currency has been validated;

third means comprising a counter carried by said cash box for tallying the number of pieces of currency deposited in said cash box;

fourth means for locking and unlocking said cash box in a housing defining the currency validator, said cash box, when unlocked, being removable and replaceable with respect to said housing, an optical coupler in operative communication between said second means and said, said optical coupler transmitting a signal to said counter and incrementing said counter each time a piece of currency is deposited in said cash box, said optical coupler comprising a first light source maintained separate and apart from said cash box, and a first photodetector received by said cash box;

a second light source connected to said counter; and a jig adapted to receive said cash box upon removal from the currency validator, said jig having a third light source positioned for communication with said first photodetector, and a second photodetector positioned for communication with said second light source.

11. The currency validator as recite in claim 10, wherein said third means further comprises a battery received within said cash box.

12. The currency validator as recited in claim 10, wherein said counter is an up counter, capable of being incremented and not decremented.

13. The currency validator as recited in claim 12, wherein a counter maintained within said counter may be read only after application to said counter of a first numeric code.

14. The currency validator as recited in claim 13, wherein said counter may be reset only after application to said counter of said second numeric code.

15. The currency validator as recited in claim 10, wherein said third light source and said second photodetector are interconnected with control means for generating said first and second numeric codes.

* * * * *